US009082560B2

(12) United States Patent
Helms et al.

(10) Patent No.: US 9,082,560 B2
(45) Date of Patent: Jul. 14, 2015

(54) HEAT REDUCING TERMINALS INCLUDING A SURFACE HAVING PROTRUSIONS AND ELECTRICAL SWITCHING APPARATUS INCLUDING THE SAME

(71) Applicant: EATON CORPORATION, Cleveland, OH (US)

(72) Inventors: Roger W. Helms, Beaver Falls, PA (US); James G. Maloney, Industry, PA (US)

(73) Assignee: EATON CORPORATION, Cleveland, OH (US)

( * ) Notice: Subject to any disclaimer, the term of this patent is extended or adjusted under 35 U.S.C. 154(b) by 176 days.

(21) Appl. No.: 13/804,437

(22) Filed: Mar. 14, 2013

(65) Prior Publication Data

US 2014/0262709 A1 Sep. 18, 2014

(51) Int. Cl.

| | |
|---|---|
| ***H01R 4/36*** | (2006.01) |
| ***H01H 1/06*** | (2006.01) |
| ***H01R 4/30*** | (2006.01) |
| ***H01R 4/24*** | (2006.01) |

(Continued)

(52) U.S. Cl.

CPC ..... *H01H 1/06* (2013.01); *H01R 4/2408* (2013.01); *H01R 4/304* (2013.01); *H01R 4/36* (2013.01); *H01H 71/08* (2013.01); *H01R 9/24* (2013.01)

(58) Field of Classification Search

CPC ..... H01H 1/06; H01H 71/08; H01R 4/304; H01R 4/36; H01R 4/2408; H01R 9/24

USPC ..... 439/810, 812, 771

See application file for complete search history.

(56) References Cited

U.S. PATENT DOCUMENTS

| | | | | |
|---|---|---|---|---|
| 3,426,319 | A | 2/1969 | Downs et al. | |
| 4,327,957 | A | 5/1982 | Cooper, Jr. et al. | |
| 5,533,913 | A * | 7/1996 | Boehm et al. | 439/810 |

(Continued)

FOREIGN PATENT DOCUMENTS

| | | |
|---|---|---|
| DE | 199 34 550 A1 | 2/2001 |
| EP | 2 439 815 A1 | 4/2012 |

(Continued)

OTHER PUBLICATIONS

European Patent Office, "International Search Report and Written Opinion", May 9, 2014, 9 pp.

(Continued)

*Primary Examiner* — Felix O Figueroa

(74) *Attorney, Agent, or Firm* — Eckert Seamans Cherin & Mellott, LLC; John P. Powers

(57) ABSTRACT

A terminal includes a fastener; a conductor member having a plurality of protrusions on a surface thereof facing the fastener; and a collar member. The collar member includes first, second, third and fourth surfaces, a tapped opening on the first surface engaging the fastener, and a conduit between the second and third surfaces. The tapped opening intersects and coincides with the conduit and is normal thereto. The fourth surface is opposite the first surface and contains another opening that intersects and coincides with the conduit. The other opening receives the conductor member. The protrusions and the surface of the conductor member are structured to engage a stranded conductor having a plurality of individual solid conductors. The fastener is structured to engage the stranded conductor.

20 Claims, 5 Drawing Sheets

(51) Int. Cl.
*H01H 71/08* (2006.01)
*H01R 9/24* (2006.01)

(56) References Cited

U.S. PATENT DOCUMENTS

| | | | | |
|---|---|---|---|---|
| 5,727,314 | A * | 3/1998 | Ashcraft | 29/884 |
| 6,280,264 | B1 * | 8/2001 | Whipple et al. | 439/814 |
| 6,338,658 | B1 | 1/2002 | Sweeney | |
| 6,579,131 | B1 * | 6/2003 | Ashcraft et al. | 439/798 |
| 6,726,510 | B2 * | 4/2004 | Norbert et al. | 439/810 |
| 6,942,527 | B1 * | 9/2005 | Lias et al. | 439/814 |
| 7,056,163 | B2 | 6/2006 | Hay | |
| 7,090,544 | B2 * | 8/2006 | Campbell et al. | 439/810 |
| 7,104,832 | B2 * | 9/2006 | Campbell et al. | 439/411 |
| 7,338,333 | B2 * | 3/2008 | Norden | 439/814 |
| 7,883,382 | B2 | 2/2011 | Howard et al. | |
| 8,157,603 | B2 * | 4/2012 | Trico | 439/810 |

FOREIGN PATENT DOCUMENTS

| | | | |
|---|---|---|---|
| FR | 2 761 540 | A1 | 10/1998 |
| FR | 2 858 470 | A1 | 2/2005 |
| FR | 2 909 804 | A1 | 6/2008 |
| FR | 2 977 392 | A1 | 1/2013 |

OTHER PUBLICATIONS

Connector Manufacturing Company, Inc., "OEM Products" Neutral Bars Type: NA, http://www.cmclugs.com/oem_products.asp?a=oem_products_detail&ProductTypeID=26, 2004, 2 pp.
Connector Manufacturing Company, Inc., "OEM Products" Tap Connectors Type: GP/GT, http://www.cmclugs.com/oem_products.asp?a=oem_products_detail&ProductTypeID=24, 2004, 2 pp.
Connector Manufacturing Company, Inc., "OEM Products" Neutral Bar Type: SCB, http://www.cmclugs.com/oem_products.asp?a=oem_products_detail&ProductTypeID=48, 2004, 1 p.
Ilsco, "NB AL Neutral Bars", http://www.ilsco.com/ProductsDetail.aspx?kfjkff=yxAAS0RV8hshRDTXI0I%2bxA%3d%3d&fjjfhjhj=wPkoG6jpyZiQ0aKGgEfir6rYDjIJxagJHVMVeL4dhdl%3d, 1 p.
Ilsco, "TA 1 Conductor AL/CU", https://www.ilsco.com/ProductsDetail.aspx?kfjkff=iTIPWV%2b%2be436xh3axcGQqQ%3d%3d&fjjfhjhj=SOXU%2fKNWgqRNs%2fOw0hEUnEzfLLowDdZJf5WIXT8e8A4%3d,1 p.

* cited by examiner

HEAT REDUCING TERMINALS INCLUDING A SURFACE HAVING PROTRUSIONS AND ELECTRICAL SWITCHING APPARATUS INCLUDING THE SAME

BACKGROUND

1. Field

The disclosed concept pertains generally to electrical terminals, and, more particularly, to electrical terminals that reduce electrical resistance and lower temperature. The disclosed concept also pertains to an electrical switching apparatus including electrical terminals.

2. Background Information

In a load center, a known aluminum collar and terminal (e.g., for a circuit breaker, ground bar, or neutral bar) are rated at up to about 60° C. to 75° C., but ideally need to achieve a 90° C. rating (e.g., for UL testing).

The temperature of a terminal is a function of the surface area over which a stranded conductor is electrically mated to the terminal. Known terminals employ smooth surfaces for mating with a stranded conductor. Such a design can result in relatively large portions of the stranded conductor being engaged with nothing but ambient air. The resulting heat dissipation can cause the temperature of the collar of the terminal to be unnecessarily high.

There is room for improvement in terminals.

There is also room for improvement in electrical switching apparatus including terminals.

SUMMARY

These needs and others are met by embodiments of the disclosed concept in which protrusions are added to a surface that mates with a stranded conductor.

In accordance with one aspect of the disclosed concept, an electrical switching apparatus comprises: a first terminal; a second terminal; separable contacts electrically connected in series between the first terminal and the second terminal; and an operating mechanism structured to open and close the separable contacts. At least one of the first terminal and the second terminal comprises: a fastener, a conductor member having a plurality of protrusions on a surface thereof facing the fastener, and a collar member comprising: a first surface, a second surface, a third surface, a fourth surface, a tapped opening on the first surface and engaging the fastener, and a conduit between the second surface and the third surface, the tapped opening intersecting and coinciding with the conduit and being normal thereto, the fourth surface being opposite the first surface and containing another opening that intersects and coincides with the conduit, the another opening receiving the conductor member, wherein the protrusions and the surface of the conductor member are structured to engage a stranded conductor having a plurality of individual solid conductors, and wherein the fastener is structured to engage the stranded conductor.

As another aspect of the disclosed concept, a terminal component comprises: a plurality of fasteners; and an elongated member comprising: a first surface, a second surface, a third surface, a plurality of tapped openings on the first surface, each of the tapped openings engaging a corresponding one of the fasteners, and a plurality of conduits between the second surface and the third surface, each of the tapped openings intersecting and coinciding with a corresponding one of the conduits and being normal thereto, each of the conduits having a plurality of protrusions on a surface thereof facing a corresponding one of the fasteners, wherein the protrusions are structured to engage a corresponding stranded conductor having a plurality of individual solid conductors, and wherein each of the fasteners is structured to engage a corresponding stranded conductor.

As another aspect of the disclosed concept, a terminal comprises: a fastener; a conductor member having a plurality of protrusions on a surface thereof facing the fastener; and a collar member comprising: a first surface, a second surface, a third surface, a fourth surface, a tapped opening on the first surface and engaging the fastener, and a conduit between the second surface and the third surface, the tapped opening intersecting and coinciding with the conduit and being normal thereto, the fourth surface being opposite the first surface and containing another opening that intersects and coincides with the conduit, the another opening receiving the conductor member, wherein the protrusions and the surface of the conductor member are structured to engage a stranded conductor having a plurality of individual solid conductors, and wherein the fastener is structured to engage the stranded conductor.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "plurality" shall mean an integer greater than one.

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

Figure 1:
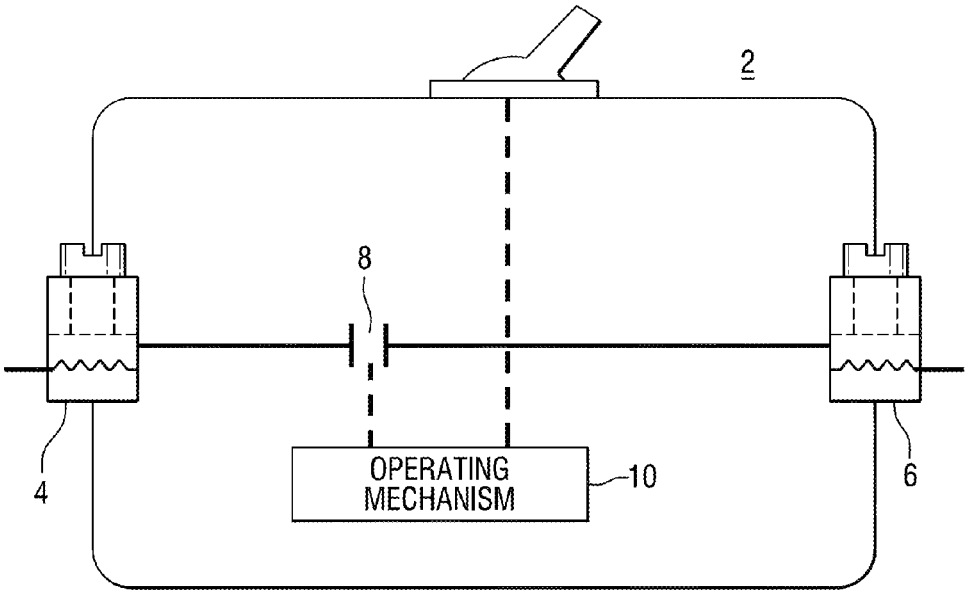
FIG. 1 is a schematic diagram in block form of an electrical switching apparatus including two terminals, at least one of which has a conductor with a surface including a plurality of protrusions in accordance with embodiments of the disclosed concept.

The disclosed concept is described in association with electrical switching apparatus and terminals, although the disclosed concept is applicable to a wide range of electrical applications. FIG. 1 shows an electrical switching apparatus, such as an example circuit breaker 2. The circuit breaker 2 includes two terminals 4, 6 and separable contacts 8 electrically connected in series between the terminals 4, 6. As shown in FIG. 1, an operating mechanism 10 is structured to open and close the separable contacts 8. In accordance with the disclosed concept, at least one of the terminals 4, 6 of the circuit breaker 2 includes protrusions as will be described.

Figure 2:
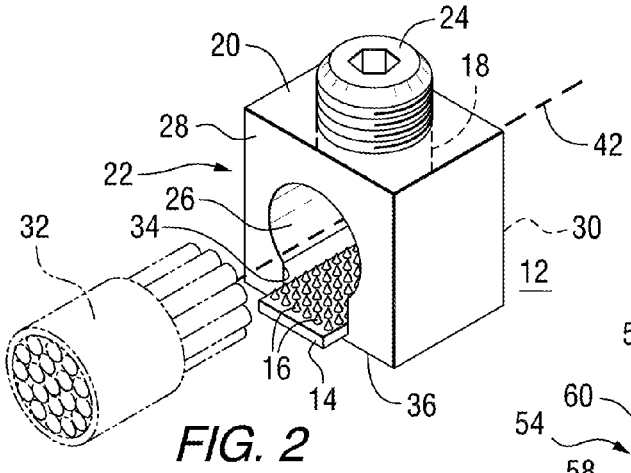
FIG. 2 is a front isometric view of a terminal including a conductor with a serrated surface in accordance with an embodiment of the disclosed concept.
Figure 3:
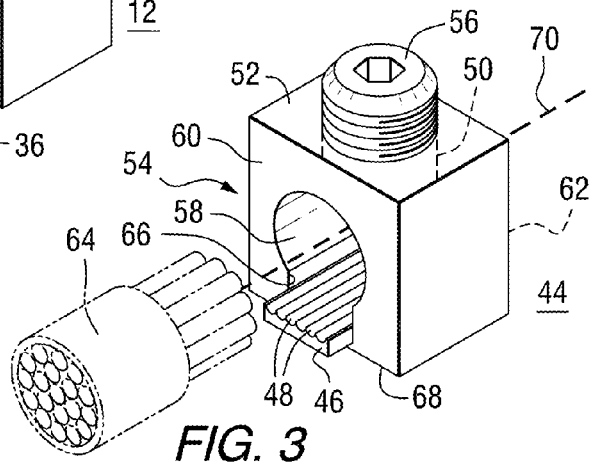
FIG. 3 is a front isometric view of a terminal including a conductor with a corrugated surface in accordance with an embodiment of the disclosed concept.

As will be discussed below in connection with FIGS. 2, 3, and 6, a desired 90° C. rating can be achieved by adding protrusions to terminal surfaces that engage stranded conductors. This creates a relatively larger surface area for engaging a stranded conductor than would be possible in the same terminal containing a smooth surface (as shown in FIG. 7) for engaging the stranded conductor. The protrusions of this improved surface penetrate into the strands of the stranded conductor. This improves electrical conductivity and reduces the millivolt voltage drop which is a function of resistance. Due to this voltage drop, the temperature of the terminal is reduced since there is less $I^2R=IV$ heating, where I is current, R is resistance, and V is voltage. The thermal conductivity is also improved by the ability of the improved terminal to wick away relatively more heat into the stranded conductor, which is conducting the current, and away from the terminal collar.

In one, non-limiting embodiment of the disclosed concept, the protrusions of the surface that engages the stranded conductor are serrated. FIG. 2 illustrates a terminal 12 wherein the surface of a conductor member 14 contains a plurality of protrusions 16 that are serrated. The terminal 12 has a tapped opening 18 (shown in hidden line drawing) on a first surface 20 of a collar member 22 for receiving a fastener 24. The terminal 12 also has a conduit 26 between a second surface 28 and a third surface 30 (shown in hidden line drawing) for receiving a stranded conductor 32 (shown in phantom line drawing), and another opening 34 on a fourth surface 36 that intersects and coincides with the conduit 26. The opening 34 is configured to receive the conductor member 14, which may be, for example and without limitation, a line conductor 38 (FIG. 4) or a load conductor 40 (FIG. 5). The stranded conductor 32 is engaged by the fastener 24, which is threadably connected to the collar member 22.

In the example embodiment, the serrated protrusions 16 are parallel to a longitudinal axis 42 of the conduit 26 and are also normal to the longitudinal axis 42. However, the example serrated protrusions 16 may be oriented in different configurations (e.g., without limitation, at varying angles with respect to the longitudinal axis 42 of the conduit 26) and still be within the scope of the disclosed concept. In the non-limiting example shown in FIG. 2, a relatively larger mating surface area is created by the relatively sharp tips of the serrated protrusions 16 penetrating into the strands of the stranded conductor 32 (e.g., without limitation, 300 MCM=300,000 circular mils). As discussed above, as the mating surface area increases, the electrical resistance decreases. This, in turn, leads to a lower temperature rise.

In an alternative, non-limiting embodiment of the disclosed concept, the protrusions of the surface that engages the stranded conductor are corrugated. FIG. 3 illustrates a terminal 44 wherein the surface of a conductor member 46 contains a plurality of protrusions 48 that are corrugated. The terminal 44 in FIG. 3 has a tapped opening 50 (shown in hidden line drawing) on a first surface 52 of a collar member 54 for receiving a fastener 56. The terminal 44 shown in FIG. 3 also has a conduit 58 between a second surface 60 and a third surface 62 (shown in hidden line drawing) for receiving a stranded conductor 64 (shown in phantom line drawing), and another opening 66 on a fourth surface 68 that intersects and coincides with the conduit 58. The opening 66 is configured to receive the conductor member 46, which may be, for example and without limitation, a line conductor 38 (FIG. 4) or a load conductor 40 (FIG. 5). The stranded conductor 64 is engaged by the fastener 56, which is threadably connected to the collar member 54.

In the example embodiment, the corrugated protrusions 48 are parallel to a longitudinal axis 70 of the conduit 58. However, the example corrugated protrusions 48 may be oriented in different configurations (e.g., without limitation, at varying angles with respect to the longitudinal axis 70 of the conduit 58) and still be within the scope of the disclosed concept. In the non-limiting example shown in FIG. 3, a relatively larger mating surface area is created by the ridges of the corrugated protrusions 48 penetrating into the strands of the stranded conductor 64. As discussed above, as the mating surface area increases, the electrical resistance decreases. This, in turn, leads to a lower temperature rise.

Figure 4:
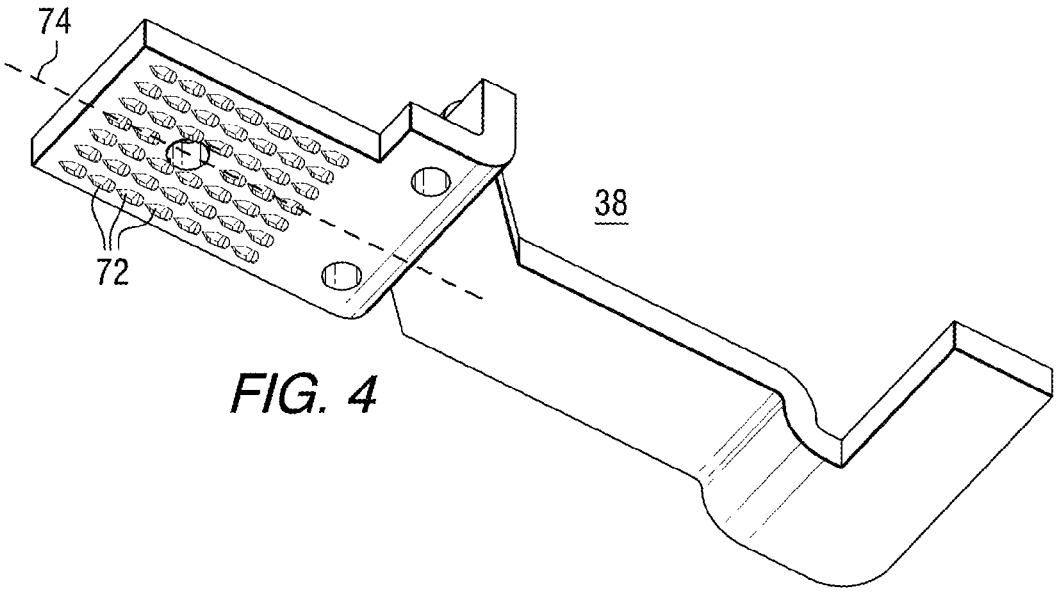
FIG. 4 is an isometric view of a line conductor with a serrated surface in accordance with an embodiment of the disclosed concept.
Figure 5:
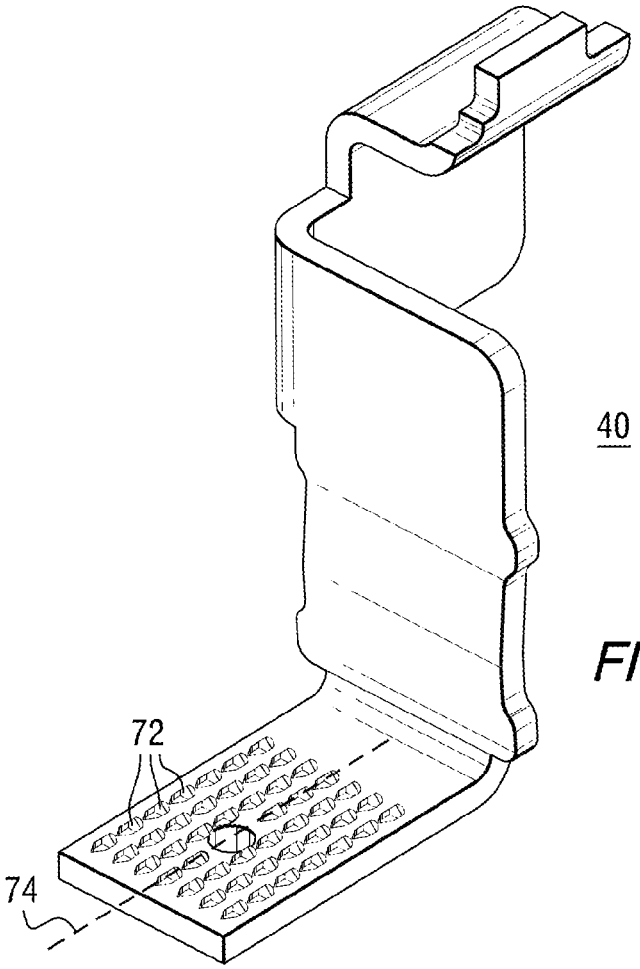
FIG. 5 is an isometric view of a load conductor with a serrated surface in accordance with an embodiment of the disclosed concept.

FIG. 4 illustrates the example line conductor 38 and FIG. 5 illustrates the example load conductor 40, each of which may be employed in accordance with embodiments of the disclosed concept. In each of the non-limiting examples shown, the protrusions 72 are serrated in a direction parallel to and normal to a longitudinal axis 74. However, it will be appreciated that each conductor may employ alternative surfaces having suitable protrusions and still be within the scope of the disclosed concept (e.g., without limitation, a corrugated surface).

Figure 6:
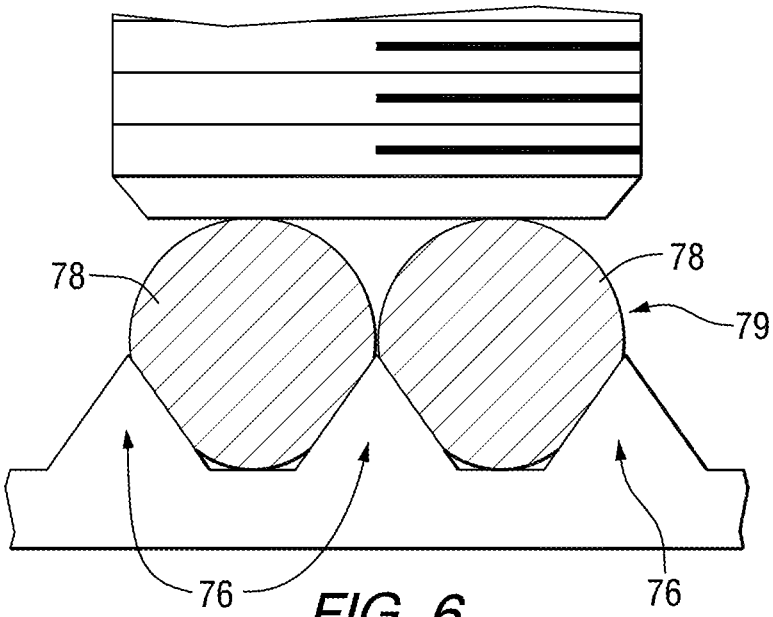
FIG. 6 is a cross-sectional view showing some of the individual conductors of a stranded conductor engaging a surface of a conductor having protrusions according to an embodiment of the disclosed concept.
Figure 7:
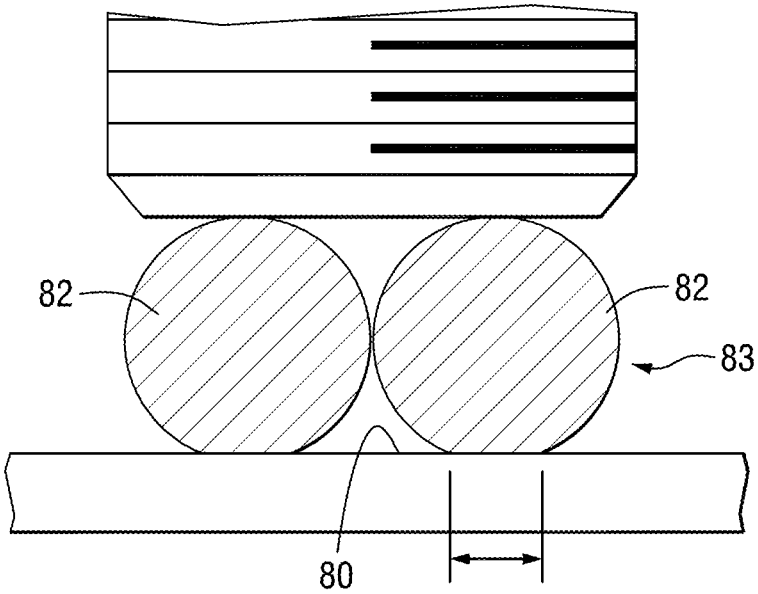
FIG. 7 PRIOR ART
FIG. 7 is a cross-sectional view showing some of the individual conductors of a stranded conductor engaging a smooth surface of a conductor.

FIG. 6 shows the protrusions 76 of an improved surface in accordance with the disclosed concept engaging the individual strands 78 of a stranded conductor 79. FIG. 7 shows the smooth surface 80 of a conventional terminal engaging the individual strands 82 of a stranded conductor 83. Comparing the two, it is clear that the mating surface area between the surface with the protrusions 76 and the individual strands 78 of the stranded conductor 79 is greater than the mating surface area between the smooth surface 80 and the individual strands 82 of the stranded conductor 83. The example protrusions 76 enable the reduction in electrical resistance and temperature that would result in a terminal employing the disclosed concept.

The disclosed concept can be applied to, for example and without limitation, circuit breaker terminals; a terminal for a power conductor; a terminal for a ground; a terminal for a neutral; a terminal (e.g., without limitation, a bimetal line terminal; a stationary line terminal; a line terminal; a load terminal) for a circuit breaker housing; and panelboard or load center terminals.

Figure 8:
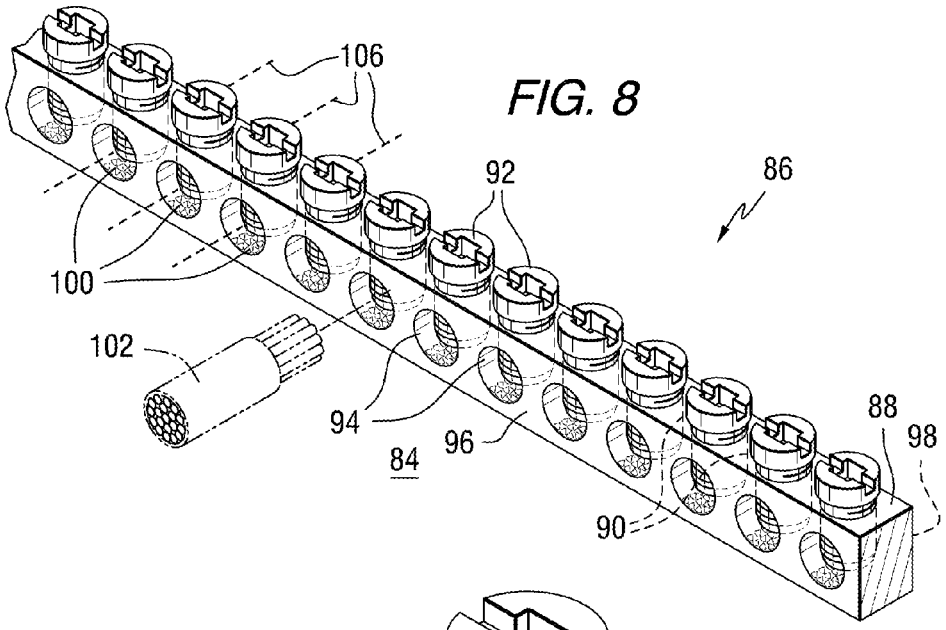
FIG. 8 is a front isometric view of a terminal component with serrated surfaces for engaging corresponding stranded conductors in accordance with an embodiment of the disclosed concept.
Figure 10:
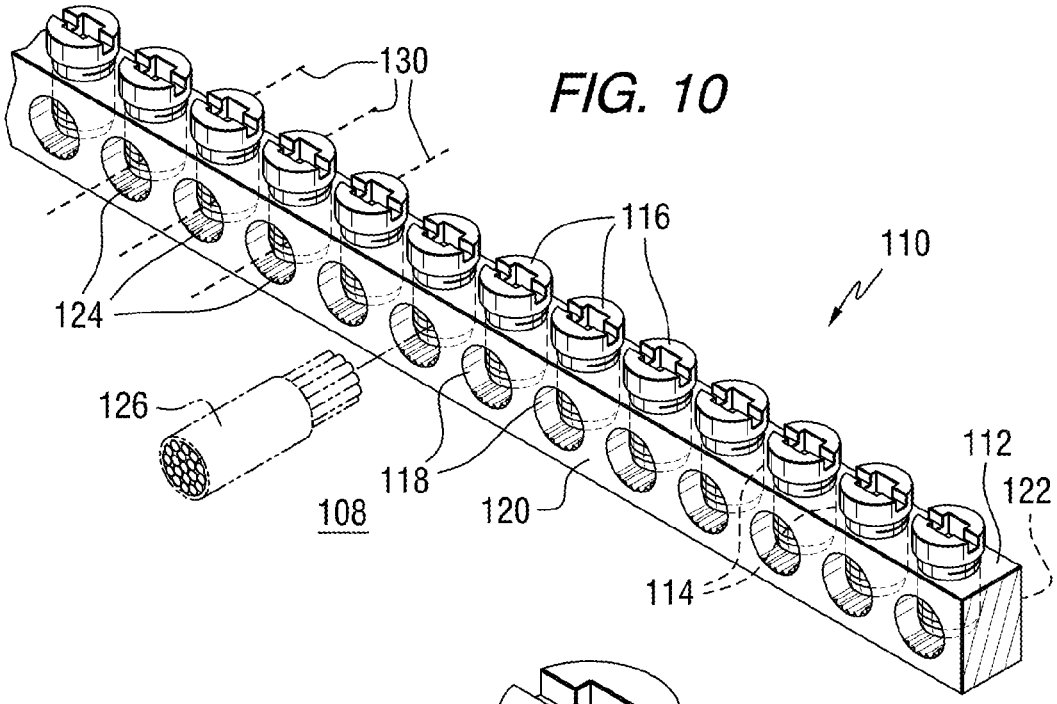
FIG. 10 is a front isometric view of a terminal component with corrugated surfaces for engaging corresponding stranded conductors in accordance with an embodiment of the disclosed concept.

In addition to the abovementioned embodiments, FIGS. 8 and 10 illustrate alternative non-limiting embodiments of the disclosed concept. FIG. 8 shows a terminal component 84, such as a ground bar or a neutral bar. The terminal component 84 is an elongated member 86 with a first surface 88 having a plurality of tapped openings 90 (shown in hidden line drawing) for receiving a corresponding plurality of fasteners 92.

Additionally, the terminal component 84 has a plurality of conduits 94 between a second surface 96 and a third surface 98 (shown in hidden line drawing). The tapped openings 90 on the first surface 88 intersect and coincide with the corresponding conduits 94. The conduits 94 each have a plurality of protrusions 100 on the surfaces that receive and engage a corresponding stranded conductor 102 (shown in phantom line drawing).

Figure 9:
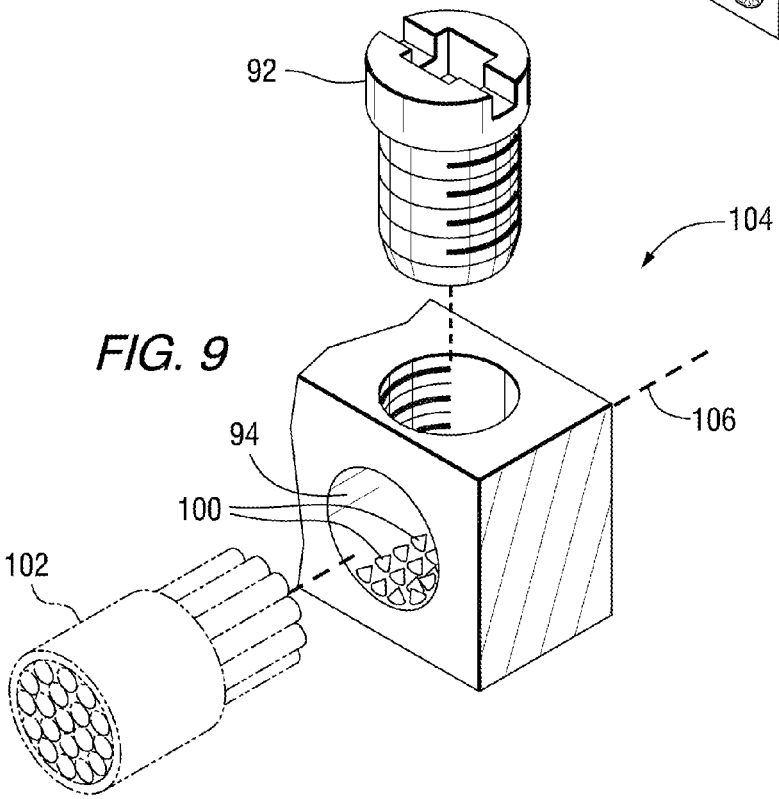
FIG. 9 is a front isometric view of a portion of the terminal component of FIG. 8.

As shown in FIG. 9, which is a portion 104 of the terminal component 84 of FIG. 8, the protrusions 100 according to this non-limiting embodiment are serrated. FIG. 9 also shows that the individual serrated protrusions 100 are parallel to and normal to a longitudinal axis 106 of each corresponding conduit 94. However, it will be appreciated that the serrated protrusions 100 may be oriented in different configurations (e.g., without limitation, at varying angles with respect to the longitudinal axis 106 of the conduits 94) and still be within the scope of the disclosed concept. The stranded conductors 102 are engaged by a corresponding one of the fasteners 92, which are threadably connected to the elongated member 86. Such a design results in the relatively sharp tips of the serrated protrusions 100 penetrating into the strands of each corresponding stranded conductor 102 (e.g., without limitation, 300 MCM=300,000 circular mils). For reasons set forth above, the increased mating surface area results in a lower electrical resistance, which, in turn, results in a lower temperature rise.

FIG. 10 shows a terminal component 108, such as a ground bar or a neutral bar. The terminal component 108 is an elongated member 110 with a first surface 112 having a plurality of tapped openings 114 (shown in hidden line drawing) for receiving a corresponding plurality of fasteners 116. Additionally, the terminal component 108 has a plurality of conduits 118 between a second surface 120 and a third surface 122 (shown in hidden line drawing). The plurality of tapped openings 114 on the first surface 112 intersect and coincide with the corresponding conduits 118. The conduits 118 each have a plurality of protrusions 124 on the surfaces that receive and engage a corresponding stranded conductor 126 (shown in phantom line drawing).

Figure 11:
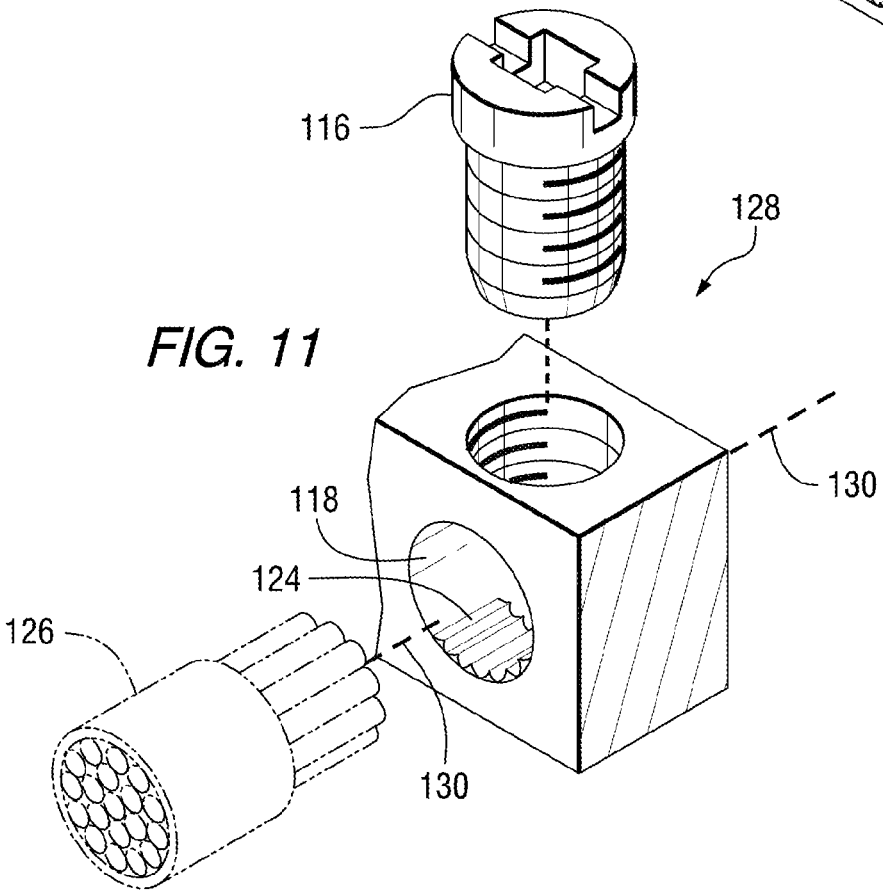
FIG. 11 is a front isometric view of a portion of the terminal component of FIG. 10.

As shown in FIG. 11, which is a portion 128 of the terminal component 108 of FIG. 10, the protrusions 124 according to this non-limiting embodiment are corrugated. FIG. 11 also illustrates that the corrugated protrusions 124 of the instant embodiment are parallel to a longitudinal axis 130 of each corresponding conduit 118. However, it will be appreciated that the corrugated protrusions 124 may be oriented in different configurations (e.g., without limitation, at varying angles with respect to the longitudinal axis 130 of the conduit 118) and still be within the scope of the disclosed concept. The stranded conductors 126 are engaged by a corresponding one of the fasteners 116, which are threadably connected to the elongated member 110. Such a design results in the ridges of the corrugated protrusions 124 penetrating into the strands of each corresponding stranded conductor 126. For reasons set forth above, the increased mating surface area results in a lower electrical resistance, which, in turn, results in a lower temperature rise.

In the aforementioned embodiments employing a serrated surface, the serrated protrusions are formed, for example and without limitation, by a progressive die with a form block. The collar may need to be, for example and without limitation, comprised of two separate pieces. In such a collar, the bottom piece would contain the serrated protrusions and the top piece would maintain the tapped opening. The two pieces would then be joined by any suitable mechanism known in the art. In an alternative non-limiting embodiment, the serrated protrusions could be formed on a separate piece, such as, for example and without limitation, a line conductor or a load conductor. The separate piece would then be joined to the collar by any suitable mechanism known in the art.

The example conductor members 14, 46, 38, 40 can be made of copper, aluminum, or any other suitable conductor material. The example collar members 22, 54 can be made of aluminum, extruded aluminum, steel, or stainless steel with copper. If the panelboard or load center (not shown) for the circuit breaker 2 is allowed to run hotter (e.g., 90° C. versus 60° C. to 75° C.), a cost reduction can be provided by removing copper from the conductor member of the terminal.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus comprising:

a first terminal;

a second terminal;

separable contacts electrically connected in series between said first terminal and said second terminal; and an operating mechanism structured to open and close said separable contacts, wherein at least one of said first terminal and said second terminal comprises:

a fastener, a conductor member having a plurality of protrusions on a surface thereof facing said fastener, and a metallic collar member comprising:

a first surface, a second surface, a third surface, a fourth surface, a tapped opening on the first surface and engaging said fastener, and a conduit between the second surface and the third surface, the tapped opening intersecting and coinciding with said conduit and being normal thereto, the fourth surface being opposite the first surface and containing another opening that intersects and coincides with said conduit, said another opening receiving said conductor member, wherein the protrusions and the surface of said conductor member are structured to engage a stranded conductor having a plurality of individual solid conductors, wherein said fastener is structured to engage said stranded conductor, wherein the conduit has a longitudinal axis extending between the second surface and the third surface;

wherein the plurality of protrusions comprises a first protrusion and a second protrusion adjacent the first protrusion in a direction normal to the longitudinal axis, wherein at least one of said individual solid conductors is disposed between the first protrusion and the second protrusion, and wherein said at least one of said individual conductors extends from the surface of said conductor member toward said fastener.

2. The electrical switching apparatus of claim 1, wherein the conductor member comprises a plurality of bends.

3. The electrical switching apparatus of claim 1, wherein the conductor member is a line conductor electrically connected to one of said separable contacts.

4. The electrical switching apparatus of claim 1, wherein the conductor member is a load conductor electrically connected to one of said separable contacts.

5. The electrical switching apparatus of claim 1, wherein said protrusions are serrated in a direction parallel to said longitudinal axis and in the direction normal thereto.

6. The electrical switching apparatus of claim 1, wherein said protrusions are corrugated in a direction parallel to said longitudinal axis; wherein each of said protrusions has a pair of opposing recessed portions and a peak portion disposed between the recessed portions; and wherein the peak portion extends longitudinally from proximate the second surface toward the third surface.

7. The electrical switching apparatus of claim 1, wherein said electrical switching apparatus is a circuit breaker.

8. The electrical switching apparatus of claim 1, wherein said first terminal and said second terminal each comprises:

a fastener, a conductor member having a plurality of protrusions on a surface thereof facing said fastener, and a metallic collar member comprising:

a first surface, a second surface, a third surface, a fourth surface, a tapped opening on the first surface and engaging said fastener, and a conduit between the second surface and the third surface, the tapped opening intersecting and coinciding with said conduit and being normal thereto, the fourth surface being opposite the first surface and containing another opening that intersects and coincides with said conduit, said another opening receiving said conductor member, wherein the protrusions and the surface of said conductor member are structured to engage a stranded conductor having a plurality of individual solid conductors, wherein said fastener is structured to engage said stranded conductor, wherein the conduit has a longitudinal axis extending between the second surface and the third surface;

wherein the plurality of protrusions comprises a first protrusion and a second protrusion adjacent the first protrusion in a direction normal to the longitudinal axis, wherein at least one of said individual solid conductors is disposed between the first protrusion and the second protrusion, and wherein said at least one of said individual conductors extends from the surface of said conductor member toward said fastener.

9. The electrical switching apparatus of claim 1, wherein said plurality of protrusions are a plurality of rows of protrusions and a plurality of columns of protrusions.

10. The electrical switching apparatus of claim 1 wherein the surface is a planar surface; and wherein the planar surface separates the first protrusion from the second protrusion.

11. A terminal component comprising:

a plurality of threaded fasteners; and an elongated member comprising:

a first surface, a second surface, a third surface, a plurality of tapped openings on the first surface, each of the tapped openings engaging a corresponding one of said fasteners, and a plurality of conduits between the second surface and the third surface, each of the tapped openings intersecting and coinciding with a corresponding one of the conduits and being normal thereto, each of said conduits having a plurality of protrusions on a surface thereof facing a corresponding one of said fasteners, wherein the protrusions and the surface of each corresponding conduit are structured to engage a corresponding stranded conductor having a plurality of individual solid conductors, wherein each of said fasteners is structured to engage a corresponding stranded conductor without any intermediate components, wherein said fastener is structured to engage said stranded conductor, wherein at least one of the conduits has a longitudinal axis extending between the second surface and the third surface, wherein the plurality of protrusions of said at least one of the conduits comprises a first protrusion and a second protrusion adjacent the first protrusion in a direction normal to the longitudinal axis, wherein at least one of said individual solid conductors is disposed between the first protrusion and the second protrusion, and wherein said at least one of said individual conductors extends from the surface of said at least one of the conduits toward a respective one of said fasteners.

12. The terminal component of claim 11, wherein said terminal component is a neutral bar.

13. The terminal component of claim 11, wherein said terminal component is a ground bar.

14. The terminal component of claim 11, wherein said protrusions are serrated in a direction parallel to said longitudinal axis and in the direction normal thereto.

15. The terminal component of claim 11, wherein said protrusions are corrugated in a direction parallel to said longitudinal axis.

16. A terminal comprising:

a fastener;

a conductor member having a plurality of protrusions on a surface thereof facing said fastener; and a metallic collar member comprising:

a first surface, a second surface, a third surface, a fourth surface, a tapped opening on the first surface and engaging said fastener, and a conduit between the second surface and the third surface, the tapped opening intersecting and coinciding with said conduit and being normal thereto, the fourth surface being opposite the first surface and containing another opening that intersects and coincides with said conduit, said another opening receiving said conductor member, wherein the protrusions and the surface of said conductor member are structured to engage a stranded conductor having a plurality of individual solid conductors, wherein said fastener is structured to engage said stranded conductor, wherein the conduit has a longitudinal axis extending between the second surface and the third surface;

wherein the plurality of protrusions comprises a first protrusion and a second protrusion adjacent the first protrusion in a direction normal to the longitudinal axis, wherein at least one of said individual solid conductors is disposed between the first protrusion and the second protrusion, and wherein said at least one of said individual conductors extends from the surface of said conductor member toward said fastener.

17. The terminal of claim 16, wherein said protrusions are serrated in a direction parallel to said longitudinal axis and in the direction normal thereto.

18. The terminal of claim 16, wherein said protrusions are corrugated in a direction parallel to said longitudinal axis; wherein each of said protrusions has a pair of opposing recessed portions and a peak portion disposed between the recessed portions; and wherein the peak portion extends longitudinally from proximate the second surface toward the third surface.

19. The terminal of claim 16, wherein said plurality of protrusions are a plurality of rows of protrusions and a plurality of columns of protrusions.

20. The terminal of claim 16 wherein the surface is a planar surface; and wherein the planar surface separate the first protrusion from the second protrusion.

* * * * *